US010206020B2

(12) United States Patent
Zuccaro

(10) Patent No.: US 10,206,020 B2
(45) Date of Patent: Feb. 12, 2019

(54) SYSTEM FOR SUCTION-CUP ATTACHABLE, PORTABLE AMPLIFIER FOR ELECTRIC GUITAR

(71) Applicant: Kevin Zuccaro, Simi Valley, CA (US)

(72) Inventor: Kevin Zuccaro, Simi Valley, CA (US)

( * ) Notice: Subject to any disclaimer, the term of this patent is extended or adjusted under 35 U.S.C. 154(b) by 0 days.

(21) Appl. No.: 15/426,023

(22) Filed: Feb. 6, 2017

(65) Prior Publication Data

US 2018/0227653 A1 Aug. 9, 2018

(51) Int. Cl.

| | |
|---|---|
| ***G10H 3/18*** | (2006.01) |
| ***H04R 1/02*** | (2006.01) |
| ***H04R 3/04*** | (2006.01) |

(52) U.S. Cl.

CPC ..... *H04R 1/026* (2013.01); *G10H 3/186* (2013.01); *H04R 3/04* (2013.01); *G10H 2210/155* (2013.01); *G10H 2230/035* (2013.01); *H04R 2201/028* (2013.01); *H04R 2420/09* (2013.01)

(58) Field of Classification Search

CPC .... H04R 1/026; H04R 3/04; H04R 2201/028; H04R 1/46; G10H 2210/155; G10H 2220/175; G10H 2230/035; G10H 3/146

USPC ..... 381/91, 174, 366, 162, 361; 84/733; 984/365

See application file for complete search history.

(56) References Cited

U.S. PATENT DOCUMENTS

| | | | | |
|---|---|---|---|---|
| 4,495,641 | A * | 1/1985 | Vernino | G10H 3/146 381/162 |
| 5,864,083 | A * | 1/1999 | Caren | G10H 1/46 84/322 |
| 2014/0224099 | A1* | 8/2014 | Webman | G10H 3/18 84/630 |
| 2016/0346958 | A1* | 12/2016 | Steele | B29C 70/38 |

OTHER PUBLICATIONS

AMZFX (Guitar Pickup Signals—Measuring Guitar Output)—2002 http://www.muzique.com/lab/pick.htm (Year: 2002).*

Semi-acoustic guitar—Wikipedia, Aug. 18, 2015 https://en.wikipedia.org/wiki/Semi-acoustic guitar (Year: 2015).*

* cited by examiner

*Primary Examiner* — Yogeshkumar Patel

(74) *Attorney, Agent, or Firm* — Law Office of Scott C Harris, Inc

(57) ABSTRACT

An amplifier device has a high output speaker, which is connected a printed circuit board (PCB) mounted within said amplifier housing. A digital signal processor circuit is contained within the PCB board to filter out the low frequency sounds. The amplifier device also has a rechargeable battery connected to the PCB board. The amplifier housing is wrapped in an outer rubber housing mounted on a suction cup for adhering to an electric guitar. The amplifier device has control panel buttons built into the device to customize the sound produced through the speaker such as distortion, chorus and reverb.

9 Claims, 6 Drawing Sheets

SYSTEM FOR SUCTION-CUP ATTACHABLE, PORTABLE AMPLIFIER FOR ELECTRIC GUITAR

BACKGROUND OF THE INVENTION

Musicians have a very close relationship to the instruments they play. After years of playing them on stage, they become very attached to them, such that their instruments become almost an extension of themselves.

Where some electric guitar players switch to playing acoustic guitar if they do not have an amplifier, many do not because they want to play the instrument they have become accustomed to playing every day.

Current invention has been developed to meet the requirements of electric guitar players who want to play her/his electric guitar whenever she/he wants to.

SUMMARY OF THE INVENTION

A portable amplifier/speaker combination device for electric guitar. The speaker is connected to a printed circuit board (PCB) mounted within an amplifier housing. A digital signal processor integrated circuit is contained within the PCB board to provide equalization/tuning for the speaker and to generate the device's sound "effects". The amplifier device also has a rechargeable battery connected to the PCB board. The amplifier device has an electric guitar input with an input sensitivity that is at 100 mv or lower. The amplifier enclosure is wrapped in an outer rubber housing attached to a suction cup for mounting on the electric guitar. The amplifier device has control panel buttons built into the device to customize the sound produced through the speaker such as distortion, chorus or reverb.

DETAILED DESCRIPTION

Figure 1:
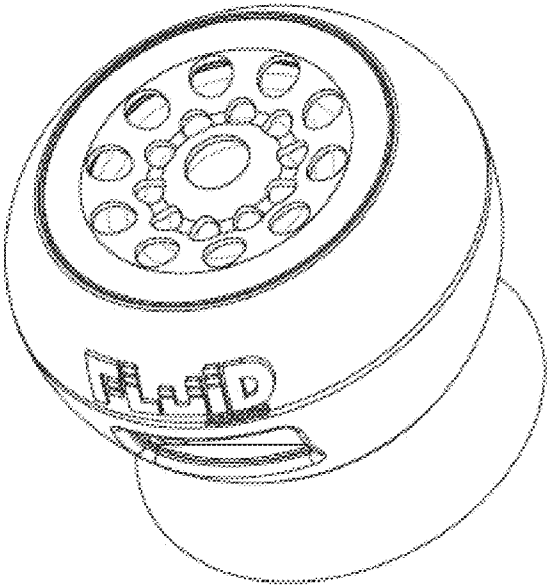
FIG. 1 shows the picture of a portable guitar amplifier.

The current invention for a portable guitar amplifier is a small, amplified speaker system that adheres to the guitar body using a soft rubber suction cup. FIG. 1 shows the portable guitar amplifier invention.

Figure 2:
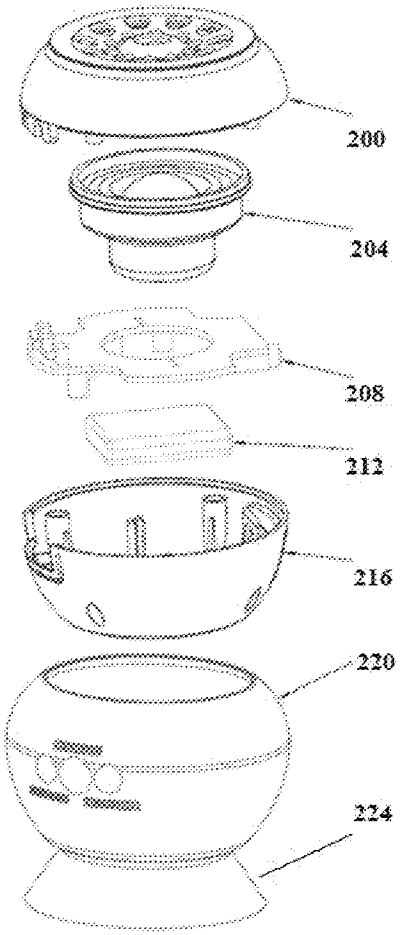
FIG. 2 shows the exploded view of the components of the portable guitar amplifier.

FIG. 2 shows an exploded view of the portable amplifier. The amplifier uses 6 watts of power or less, and receives its power from an internal, rechargeable Lithium-ion battery 212. The amplifier drives a 45 mm neodymium magnet speaker 204. The rechargeable battery can be charged using a micro USB input and the portable amplifier can be used without having to be connected to an A/C electrical power outlet. The portable amplifier consists of a small speaker, printed circuit board (PCB) 208 with a DSP integrated circuit, and a rechargeable battery powering the speaker and the PCB board.

Figure 3:
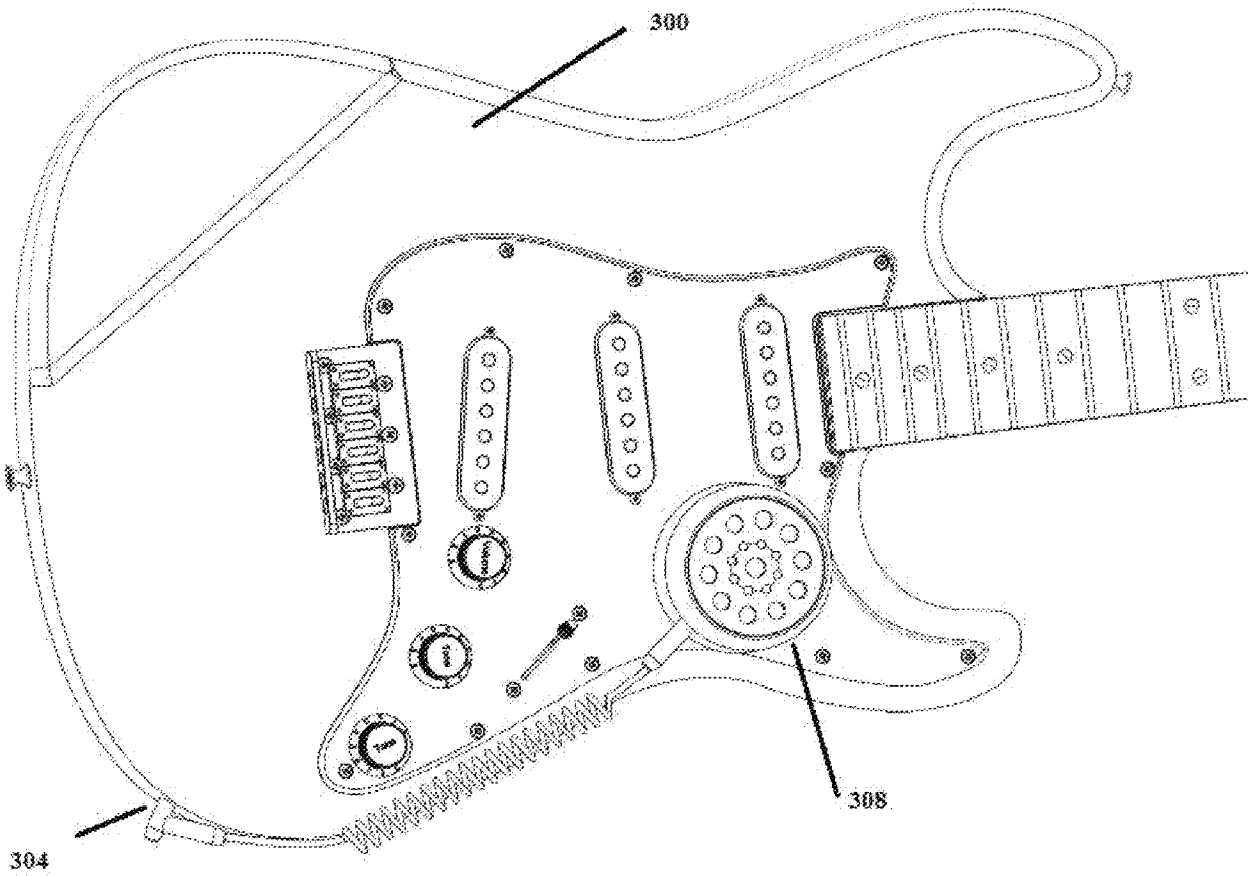
FIG. 3 shows the mounted use of the portable amplifier on an electric guitar.
Figure 4:
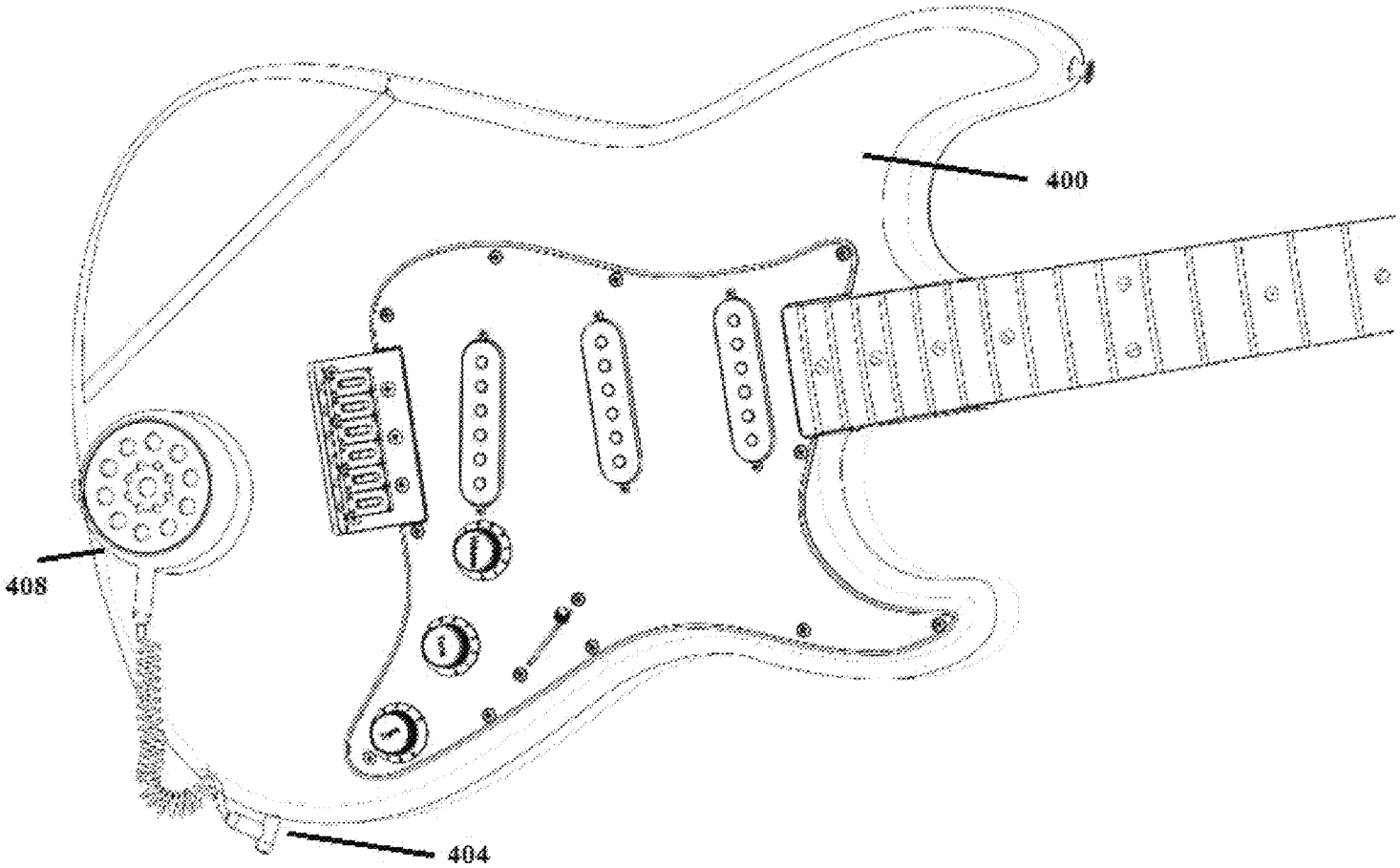
FIG. 4 shows an alternate mounting use of the portable amplifier on an electric guitar.

The amplifier is enclosed in a round plastic housing (200, 216) which has typical dimension of 7 cm. The round plastic housing is comprised of upper round housing piece 200 which is made in half circle and a lower round housing piece 216 made in an opposite half circle. The round plastic housing is also enclosed in round rubber covering 220 attached to a round suction cup 224 on the bottom. The dimension of the round rubber covering is just slightly larger than the round plastic housing to have a snug fit. The width of the rubber suction cup 224 is at least 6 cm and 1.5 cm tall so that suction cup sticks to the body of the electric guitar. The purpose of the suction cup is to allow the portable guitar amplifier to be attached to the body of an electric guitar while the musician is playing the electric guitar. FIG. 3 shows a typical mounting of the portable amp 308 on the electric guitar 300 using an output connection 304. FIG. 4 shows an alternate mounting of the portable amp 404 on the electric guitar 400 using an output connection 408.

Figure 5:
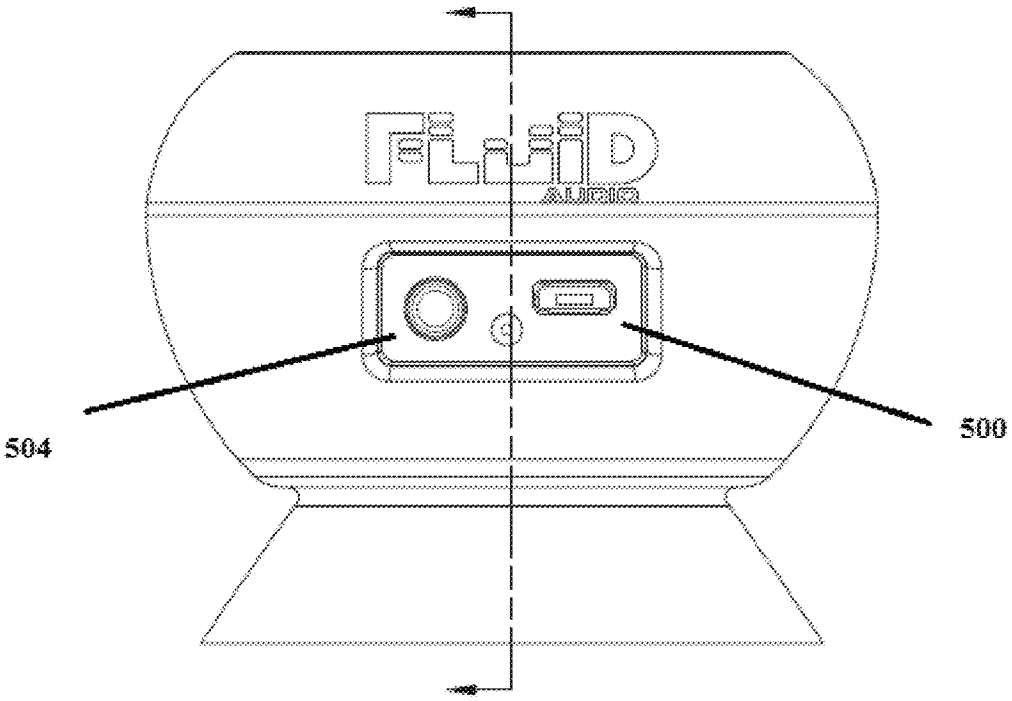
FIG. 5 shows a side view showing the electrical guitar input and the USB inputs for the portable amplifier.

FIG. 5 shows the mono jack input and the USB input to the portable amplifier. The PCB board has 3.5 mm mono jack input 504 accessible through the plastic housing to allow for a connection to the electric guitar. The PCB board also has an USB input connection to recharge the battery 500.

The portable guitar amplifier is designed to amplify a musical instrument such as an electric guitar, and as such, has some unique attributes:

The amplifier has a high input sensitivity (to accept low input voltage source). Since the guitar's output is passive, not active, its sound output is very low. Therefore, the input gain on the guitar amplifier's preamp is high before the sound reaches the amplifier stage.

Figure 6:
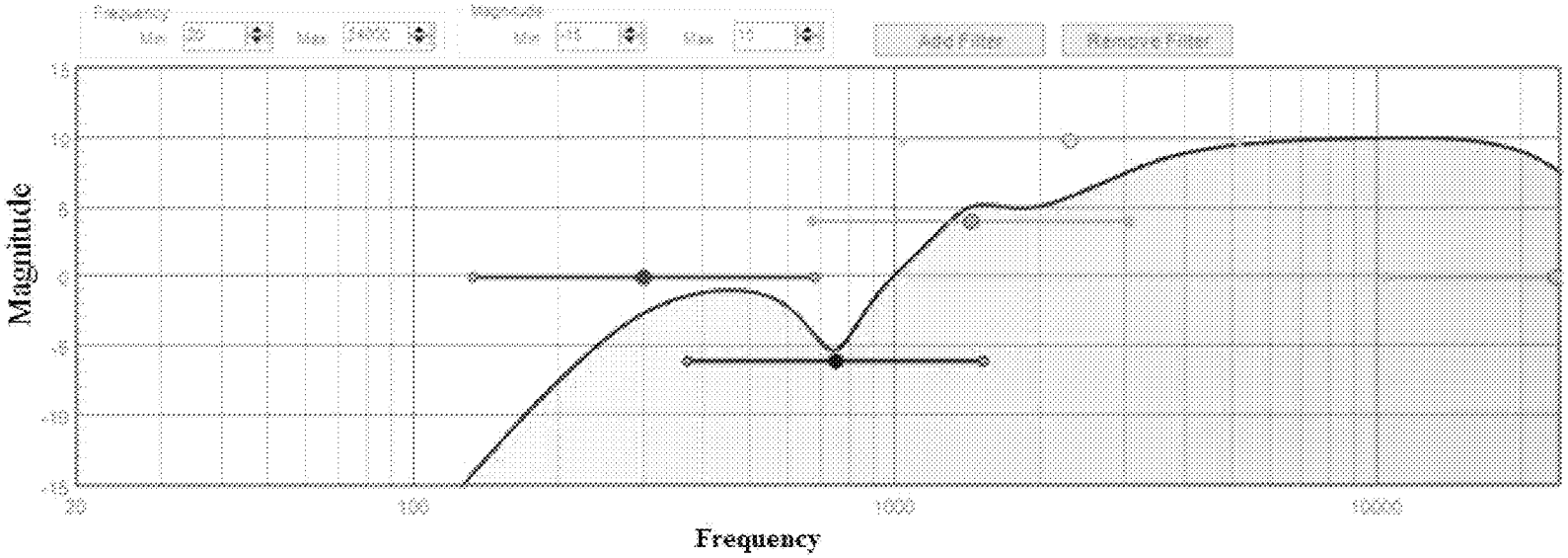
FIG. 6 shows high pass filter used in the digital signal processing to enhance the electric guitar sound.

The portable guitar amplifier has a speaker that is suited for the electric guitar's frequency response output. FIG. 6 shows the high pass filter frequency range in which the low frequency sound has been filtered out from the speaker output. The high pass filter is programmed into the DSP sound processor. The frequency range for the high pass filter is between 400 hz and 15,000 hz. The amplifier does not have a full, flat response (with a lot of bass), but rather is designed to have a narrowly focused response, able to reproduce the midrange frequencies of an electric guitar using the high pass filter.

The amplifier has been designed with unique digital sound processing (DSP) sound "effects" which enhance the sound of the guitar for different styles of music (distortion, chorus, reverb, etc.). These sound "effects" are provided using the DSP integrated circuit (IC).

This invention has a high input sensitivity required for the guitar amplifier:

Typical speaker's input sensitivity (when receiving signal from an ipod or mobile phone) are in the range of 250 to 300 mV (millivolts). The portable guitar amplifier has an input sensitivity that is at 100 mv or lower (the lower setting means that there is a higher input sensitivity).

The 80 mV input sensitivity boosts the guitar signal roughly 10 to 12 dB louder than a conventional powered speaker. This is essential because the guitar pickups (the small microphones on the guitar that "pick up" the sound from the strings) are passive, and need additional boost before the amplifier stage. Input sensitivity is controlled in the preamp on the system.

This higher input sensitivity does not work with a conventional music source such as ipod or mobile device. In fact, if a mobile phone is plugged into the guitar amplifier, the music coming out of the speaker would be very loud and distorted, that the sound would be unlistenable and highly likely damage the speaker.

Regarding the speaker equalization (EQ), as well as the "effects" that are found on the guitar amplifier: Both of these are controlled by using the on-board DSP IC, described below:

1. The audio equalizer is used to contour the frequency response of the sound within the DSP in which low frequency has response been removed using a high pass filter. The cutoff frequency of the high pass filter is set at 400 hz, and additional gain boost is added from 1500 Hz to 15,000 Hz. FIG. 6 shows the frequency range in which high pass filter is applied (as well as a mid boost) to the speaker output. This makes the sound output of the speaker more suitable to the limited sound output range of the electric guitar. Notice it is not the full frequency bandwidth ordinarily used for most speakers.

2. To enable sound processing "effects" for the guitar. Using the DSP, the system effects can turn on or off such as distortion, reverb, chorus and compression, to enhance the sound of the guitar output. The reverb, chorus and crunch effects correspond to the buttons on the amplifier body.

All examples and conditional language recited herein are intended for educational purposes to aid the reader in understanding the principles of the invention and the concepts contributed by the inventor to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents hereof. Additionally, it is intended that such equivalents include both currently known equivalents as well as equivalents developed in the future, i.e., any elements developed that perform the same function, regardless of structure.

The invention claimed is:

1. An amplifier device comprising:

a speaker;

an amplifier housing;

a printed circuit board mounted within said amplifier housing and connected to said speaker;

a wired connection, connected to said printed circuit board, the wired connection receiving audio input to be amplified and to be played over said speaker;

a digital signal processor circuit contained within said printed circuit board;

a rechargeable battery connected to said printed circuit board;

a suction cup;

an outer housing wrapped around said amplifier housing, and attached to the suction cup; and control panel buttons mounted on said amplifier housing, said control panel buttons connected to said printed circuit board, wherein said printed circuit board has a battery charging connection to recharge said battery, wherein said suction cup is round, and said amplifier housing is made from plastic rounded parts attached together, wherein the battery is housed within a lower plastic rounded part, the printed circuit board is housed within the lower rounded part, and the speaker is housed at least partially within the upper rounded part, wherein the printed circuit board includes a round hole formed therein, and the speaker extends at least partially through said hole from the upper rounded part to have a part that is located in the lower rounded part.

2. A device according to claim 1, wherein said digital signal processor is programmed with a high pass filter to enhance middle frequencies for the purpose of enhancing sound output on an electric guitar.

3. A device according to claim 1, wherein said wired connection is an input jack to connect to an electric guitar, and the input jack connects to the amplifier that has an input sensitivity that is less than 100 mv.

4. A device according to claim 1, wherein said suction cup is round, and said rounded parts of the amplifier housing are made from plastic half spheres attached together.

5. A device according to claim, 3, wherein said control panel buttons provides classic, electric guitar sound effects programmed into digital signal processor including distortion, chorus, or reverb.

6. A device according to claim 3, wherein said amplifier housing is round and the diameter of round amplifier housing is less than 7 centimeters and the diameter of the suction cup is more than 6 cm.

7. A device according to claim 6, wherein said suction cup has diameter greater than 6 cm and is large enough for, and for the purpose of, attaching on an electric guitar.

8. A device according to claim 1, wherein high pass filter for said digital signal processor range passes between 400 hz to 15,000 hz.

9. A device according to claim 1 further comprising:

an electric guitar wherein said amplified device is attached to said electric guitar, and uses suction cup and connected to said electric guitar using an audio cord.

* * * * *